US007516577B1

(12) United States Patent
Ranieri et al.

(10) Patent No.: US 7,516,577 B1
(45) Date of Patent: Apr. 14, 2009

(54) FABRIC STRUCTURES WITH TENSIONER AND TENSIONER DEVICE

(75) Inventors: Christoper Paul Ranieri, League City, TX (US); Jimmy Don Shafer, Angleton, TX (US)

(73) Assignee: Hendee Enterprises, Inc., Houston, TX (US)

( * ) Notice: Subject to any disclaimer, the term of this patent is extended or adjusted under 35 U.S.C. 154(b) by 149 days.

(21) Appl. No.: 11/608,704

(22) Filed: Dec. 8, 2006

(51) Int. Cl.
*E04B 7/02* (2006.01)

(52) U.S. Cl. ..... 52/90.1; 52/222; 52/5; 52/291

(58) Field of Classification Search ..... 52/222, 52/90.1, 5, 291, 2.24, 506.01; 135/117, 114, 135/119, 907
See application file for complete search history.

(56) References Cited

U.S. PATENT DOCUMENTS 1,642,267 A * 9/1927 Rush ..... 135/98
3,134,200 A * 5/1964 Moss ..... 52/745.14
3,707,930 A * 1/1973 Yindra et al. ..... 108/147
3,844,080 A * 10/1974 Brock et al. ..... 52/222
3,872,634 A * 3/1975 Seaman ..... 52/222
3,997,945 A * 12/1976 Robins ..... 24/129 R
4,726,153 A * 2/1988 Adler et al. ..... 52/63
5,490,532 A * 2/1996 Mallookis et al. ..... 135/117
5,930,971 A * 8/1999 Etheridge ..... 52/646
6,814,094 B1 * 11/2004 Barber ..... 135/119
6,874,518 B2 * 4/2005 Porter ..... 135/124
6,899,112 B2 * 5/2005 Tsai ..... 135/131
7,127,851 B2 * 10/2006 Morris ..... 52/22
7,316,237 B2 1/2008 Connelly
2006/0156644 A1 7/2006 Connelly

* cited by examiner

*Primary Examiner*—Basil Katcheves
(74) *Attorney, Agent, or Firm*—Buskop Law Group, PC; Wendy Buskop

(57) ABSTRACT

A fabric covered rigid frame structure having at least three elongate rafters; at least one column supporting the rafters; a fabric cover; a cord system or a web system encircling the fabric cover; and at least one tensioner formed in an end of at least one elongate rafter, wherein the tensioner includes an opening formed in an end of the elongate rafter along the axis of the rafter; a first fitting disposed between the opening and an end of the elongate rafter; a rod disposed in the elongate rafter along an axis of the rafter through the first fitting, wherein the rod comprises threads that are exposed to at least a portion of the opening; means for engaging the rod through the first fitting; and a sliding block with hook disposed on the threads of the rod interior of the elongate rafter wherein the hook engages the fabric cover.

18 Claims, 8 Drawing Sheets

FABRIC STRUCTURES WITH TENSIONER AND TENSIONER DEVICE

FIELD

The embodiments relate to building structures, particularly to fabric covered structures and to a tensioner for increasing pressure on fabric over metal or polymer framed structures.

BACKGROUND

Fabric covered metal and polymer structures are used as sunshades. These structures are used as sunshades for playgrounds, sports fields, parking lots, swimming pool decks, and other outdoor commercial and residential areas. The sunshade in such areas allows people to gather on bright sunny days without the fear of sunburn and other health consequences caused by the sun's harmful ultraviolet rays. A need exists for a self contained mechanism in the frame of such a structure, namely the rafters of a sunshade or similar device having a fabric cover, to assist a user in the installation of the fabric over the frames.

A need exists for a fabric tensioning device to enable both faster and easier installation of fabric for commercial and residential shade units of various types.

A need also exists for a fabric tensioning device that provides increased safety by minimizing the risk of a structure releasing tension, especially during high winds and other inclement weather conditions.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

One of the benefits of the disclosed fabric tensioning device is that it permits fabric covered structures of all shapes and sizes to be installed both more easily and more quickly than conventional means. As a result, fewer personnel or less skilled personnel may be required to install a fabric covered structure, and less time may be needed to complete the installation process.

Another advantage of the disclosed fabric covered structure and tensioning device is that it provides improved safety over the prior art. The unique tensioning device prevents supporting elements of the fabric covered structure from releasing tension, potentially causing injury to persons inside or in close proximity to the structure. This is a particular concern during periods of high winds, though unexpected loss of tension and related injuries can occur during other times as well.

An embodiment of the invention contemplates a fabric covered rigid frame structure with at least three elongate rafters, each having an axis, at least one column supporting each of the at least three elongate rafters, a fabric cover for covering the at least three elongate rafters, a web system comprising a plurality of web strips hemmed within the edges of the fabric cover, and at least one tensioner formed in an end of at least one elongate rafter.

Each tensioner can include an opening formed in an end of the elongate rafter, along the axis of the rafter, a first fitting disposed between the opening and the end of the elongate rafter, connected to the rafter, a threaded rod disposed in the elongate rafter along the axis of the rafter through the first fitting, a means for engaging the rod through the first fitting, and a sliding block with a hook disposed on the threads of the rod interior of the elongate rafter. The hook can extend through the opening for engaging and tensioning the fabric cover.

A hook can be any straight or curved material protruding from the rod for purposes of engaging and tensioning the fabric cover. The hook can be part of the sliding block, that is, a single, one-piece structure, or the hook can be separate and attached to the sliding block through a connecting means, such as threads, screws, bolts, or adhesives.

Figure 1:
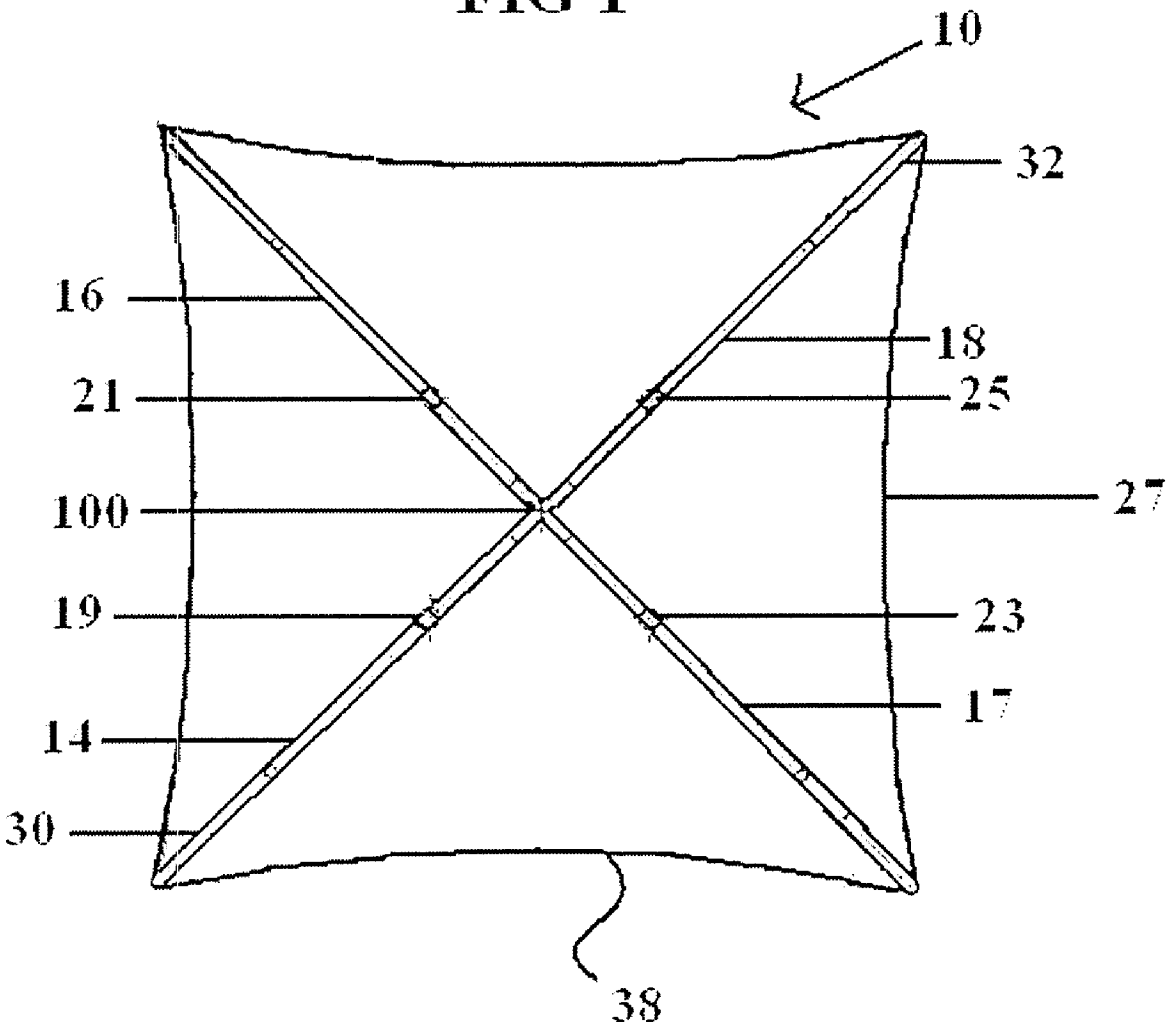
FIG. 1 is a bottom view of an embodiment of the invention with four rafters and a fabric cover with tensioners and a cord system.

Referring now to the drawings, FIG. 1 is a bottom view of a four rafter embodiment of a fabric covered rigid frame structure 10.

In this embodiment, there are four elongate rafters, a first elongate rafter 14, a second elongate rafter 16, a third elongate rafter 17, and a fourth elongate rafter 18. The invention has at least three elongate rafters in other embodiments but may possess any number of elongate rafters as required by the size and material of the fabric covered structure. Each elongate rafter has an axis longitudinally disposed down the rafter.

The elongate rafters can be made from steel, aluminum, polyvinyl chloride (PVC), another sturdy plastic tubing, graphite composite tubing, wood, or other non deformable slightly flexible material. The elongate rafters can be all hollow structures or they can be mostly solid, having hollow ends for supporting the unique tensioner.

The size of the rafters can vary. It is contemplated that one rafter could have a length from 40 inches to 40 feet, and can have an inner diameter ranging from one inch to 36 inches, though the elongate rafters can be of any length or width as required by the size and material of the fabric covered structure. The elongate rafters can be hollow or can be solid, depending on the weight of the material and purpose of the resulting structure.

Only one tensioner can be used for a frame with three elongate rafters, but more than one tensioner can be used as well, for a frame with three elongate rafters, or for a frame with a larger number of rafters. Each tensioner can be disposed at the end of an elongate rafter furthest from a central connection of the rafters.

For the four rafter embodiment of FIG. 1, there are four columns shown, one supporting each rafter. FIG. 1 shows the attaching points at the rafter for a first column 19, a second column 21, a third column 23, and a fourth column 25.

For a three elongate rafter structure, having a pyramid shape, one column could be used, supporting the elongate rafters at the peak of the structure, or three columns could be used, with one column supporting each elongate rafter. It is contemplated that a single column could support multiple elongate rafters, or that multiple columns could support a single rafter.

The columns can be made from the same material as the rafters, or can be made from different materials, such as cement. Combinations of materials, such as cement, steel, aluminum, polyvinyl chloride (PVC), other sturdy plastic tubings, graphite composite tubing, and wood can be used in the columns and structures.

In an embodiment, at least one of the columns can be connected to a corner of a rafter. The column can be connected to each rafter using bolts, screws, rivets, welding, adhesive bolding, tape, or combinations thereof.

The columns can be anchored to a foundation, the earth, to another structure, or to other stable supports.

A fabric cover 27 is used for covering the at least three elongate rafters. In FIG. 1, the fabric cover 27 is shown extending over the four elongate rafters.

The fabric cover can be made from canvas, polypropylene, polyethylene, pvc coated fabrics, copolymers of polypropylene and polyethylene, and other polymer materials, including material known as Kevlar™ and nylon, and similar parachute like materials. Other fabrics can be used as well, and can be knitted, woven, or non-woven fabrics. Additionally, fabrics like Coolaroo™ available from Gale Pacific can be used as the fabric cover.

In the embodiment of FIG. 1, a cord system 38 is shown. In another embodiment, depicted in FIG. 4, the cord system 38 is shown replaced by a web system 28 with web extensions 29*a*, 29*b*, 29*c*, and 29*d* to facilitate the tensioning of the fabric cover over a structure.

The cord system can be a wire, a cable, a chain, a hemp cord, a cotton rope, a nylon rope, a synthetic polymer rope, and combinations thereof sewn into a hem along the edge of the fabric cover in such a way that the cable can be pulled to tighten down the fabric cover.

In the four rafter embodiment of FIG. 1, there is shown a first tensioner 30 disposed opposite a second tensioner 32. The at least one tensioner is formed in an end of at least one elongate rafter. First tensioner 30 is shown formed in an end of first elongate rafter 14. Second tensioner 32 is shown formed in an end of fourth elongate rafter 18.

In this embodiment of FIG. 1, the rafter assembly is shown with a peak fitting assembly at the center, 100. The columns are shown positioned 3 feet, 6 inches apart from each other. The fabric cover is shown to be a square fabric, made from a knitted flexible material able to sustain a burst strength of between 400 PSI and 500 PSI and have ultraviolet protection. This embodiment shows the fabric to have four 12 foot long sides. It is contemplated that structures of both larger and smaller sizes with differing column positions are also able to be constructed.

The tensioner is depicted in more detail in FIGS. 5-8.

Figure 2:
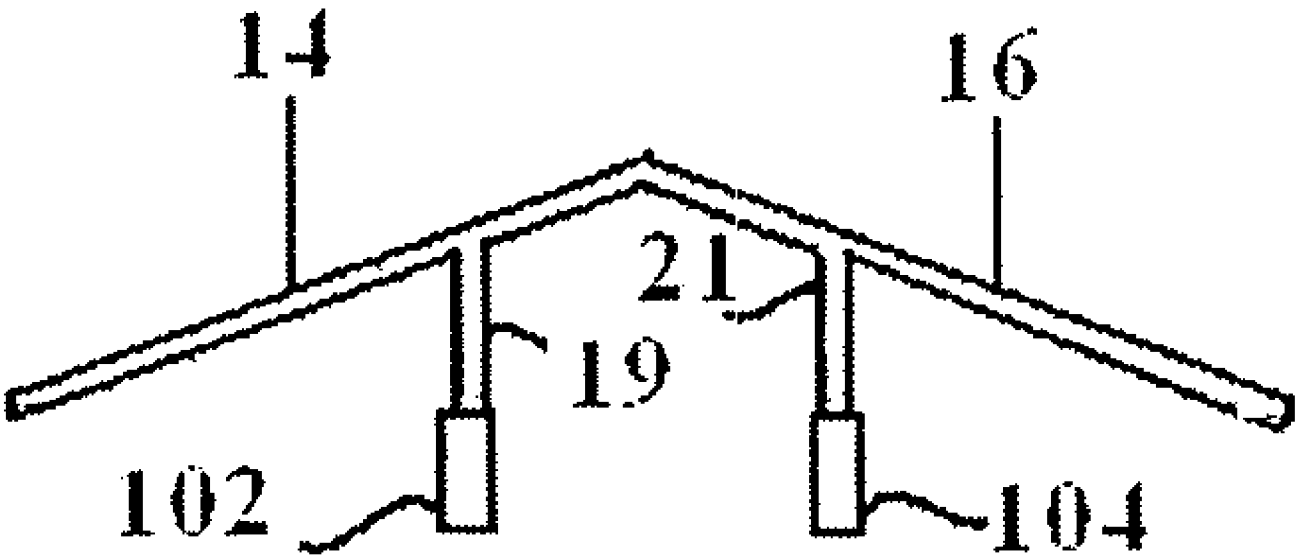
FIG. 2 shows a side view of the rafter system of FIG. 1 for supporting the fabric cover.

FIG. 2 shows a side view of the rafters 14 and 16 of the embodiment of FIG. 1 connected together at a peak. The columns in this embodiment are shown as columns 19 and 21 and are depicted to be between 2 and 3 feet tall, each anchored in the earth in a column assembly with plates 102 and 104 respectively. The columns can also be anchored to another structure, such as the roof of another building, in the earth, or using another stable structure.

In one contemplated embodiment, the rafters can be approximately 2 feet and 3.625 inches high. The distance between the columns can be about 3 feet and 6 inches.

Figure 3:
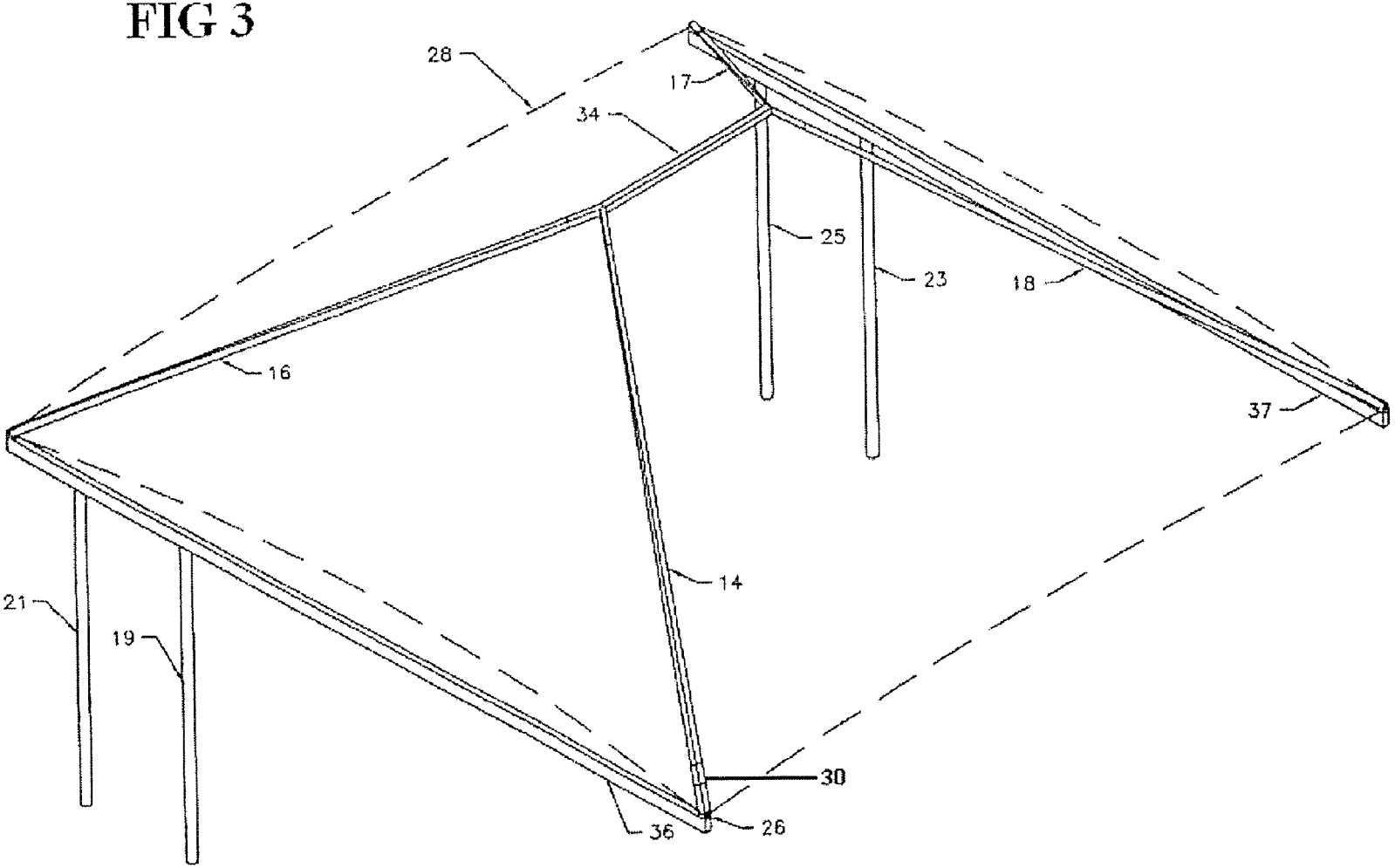
FIG. 3 is a perspective view of an embodiment of the invention with four rafters with a web system and one tensioner.

The tensioner is formed in the end of the rafters as shown in FIG. 3, which depicts a frame with a rafter having a single tensioner, wherein the fabric cover has not yet been installed. In this embodiment, the tensioner 30 is shown in the end of elongate rafter 14. Elongate rafter 14 connects to an end of a rigid beam 34 as does elongate rafter 16. Elongate rafters 17 and 18 connect to the opposite end of rigid beam 34.

Elongate rafters 14, 16, 17, 18 all connect on their opposite ends to support beams. In particular, elongate rafters 14 and 16 connect to a first support beam 36, and elongate rafters 17 and 18 connect to a second support beam 37.

Each support beam can rest on at least one column, and in this embodiment, each support beam is depicted resting on two columns. Support beam 36 is shown resting on columns 19 and 21, and support beam 37 is shown resting on columns 23 and 25.

In an embodiment where at least two rafters connect to at least one rigid beam, and each rafter engages opposite sides of a support beam, the support beam can be a cantilevered beam.

Figure 4:
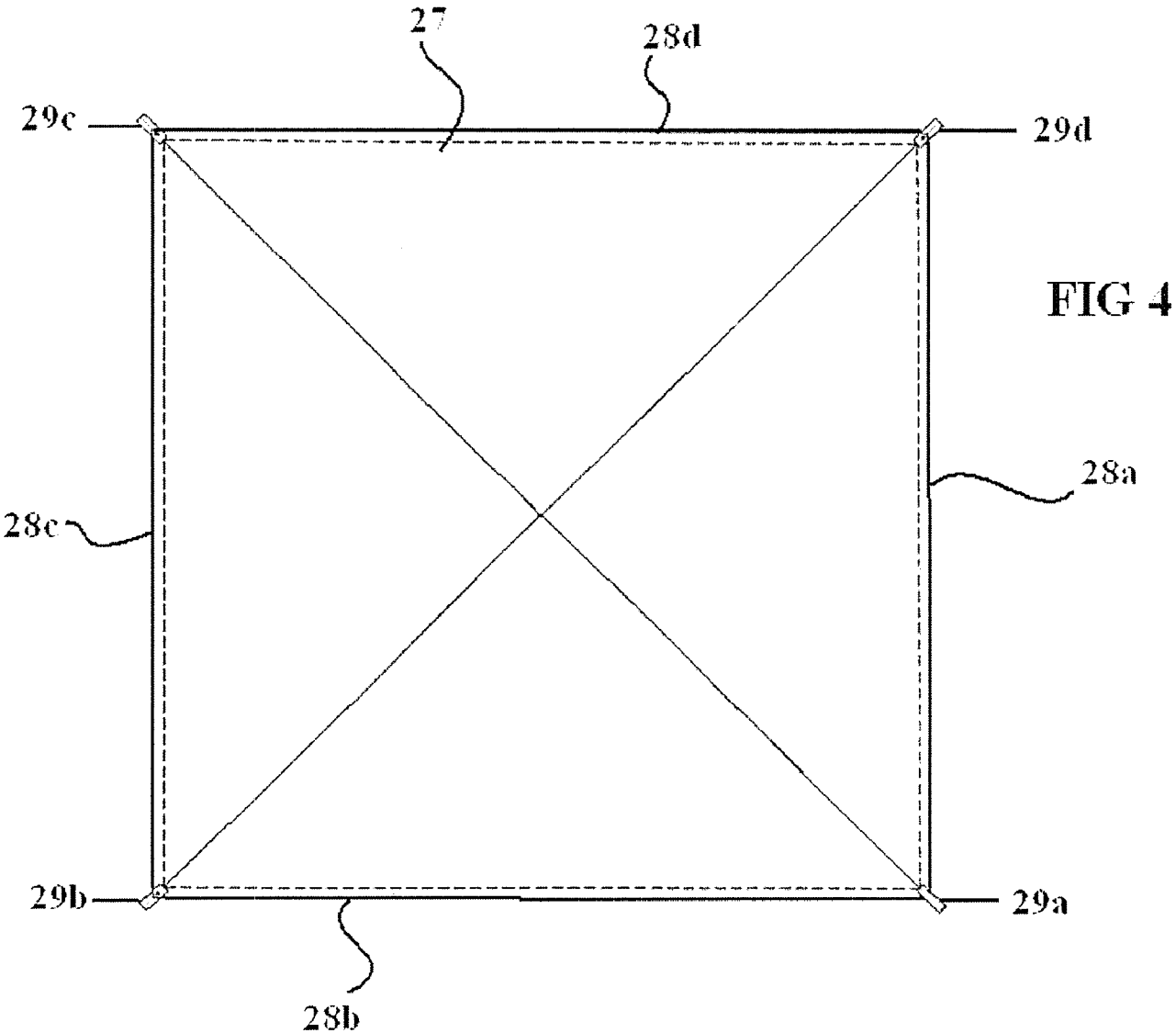
FIG. 4 shows a view of a fabric cover with a web system sewn into the fabric.

FIG. 4 shows another embodiment of the fabric cover 27 having a web system with a first web strip 28*a* on one edge of the fabric cover 27, a second web strip 28*b* connected to a second edge of the fabric cover 27, a third web strip 28*c* connected to a third edge of the fabric cover 27, and a fourth web strip 28*d* connected to a fourth edge of the fabric cover 27.

A web strip can be made from any structurally sound fabric, polymer, or metal that is suitably attached to the cover for the purpose of attaching the cover to the frame system and tensioner device. A web strip can range from 1 inch to 4 inches in width, though it is contemplated that wider and narrower web strips can be used as required by particular sizes and materials of fabric covered structures. A web strip is generally the same length as the side of the fabric cover in which the web strip has been enclosed, though it is contemplated that shorter or longer web strips may also be used.

Figure 5:
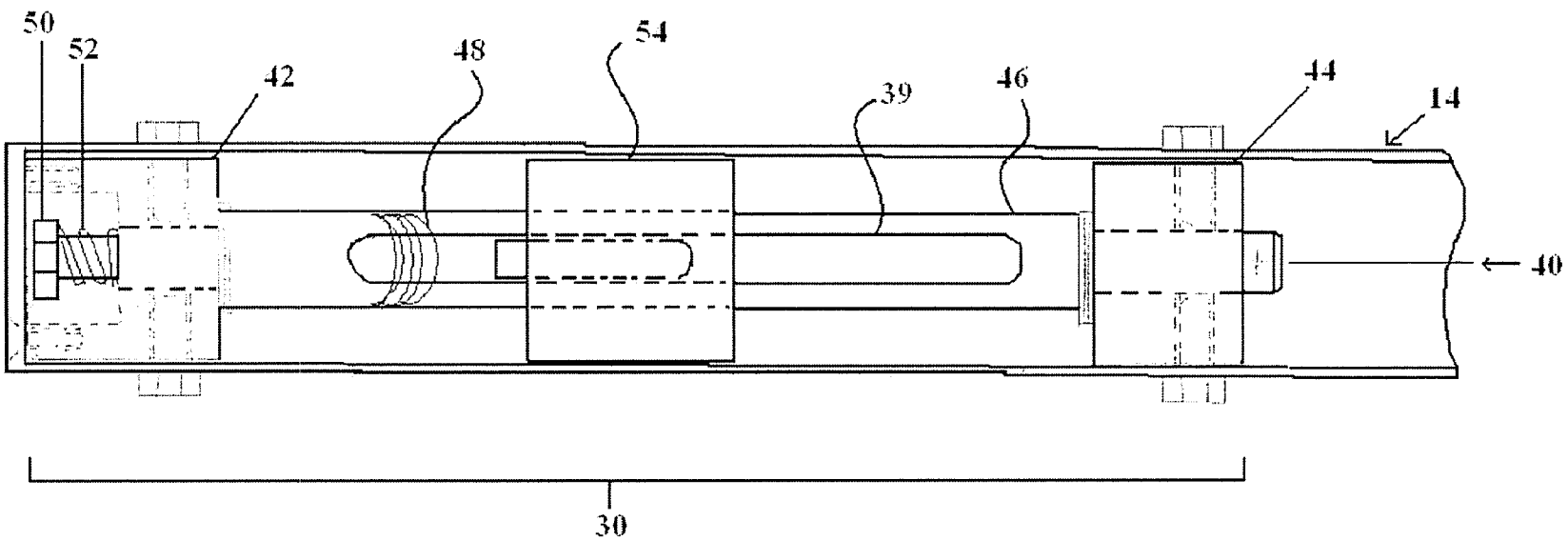
FIG. 5 shows a top view of an embodiment of the tensioner
Figure 6:
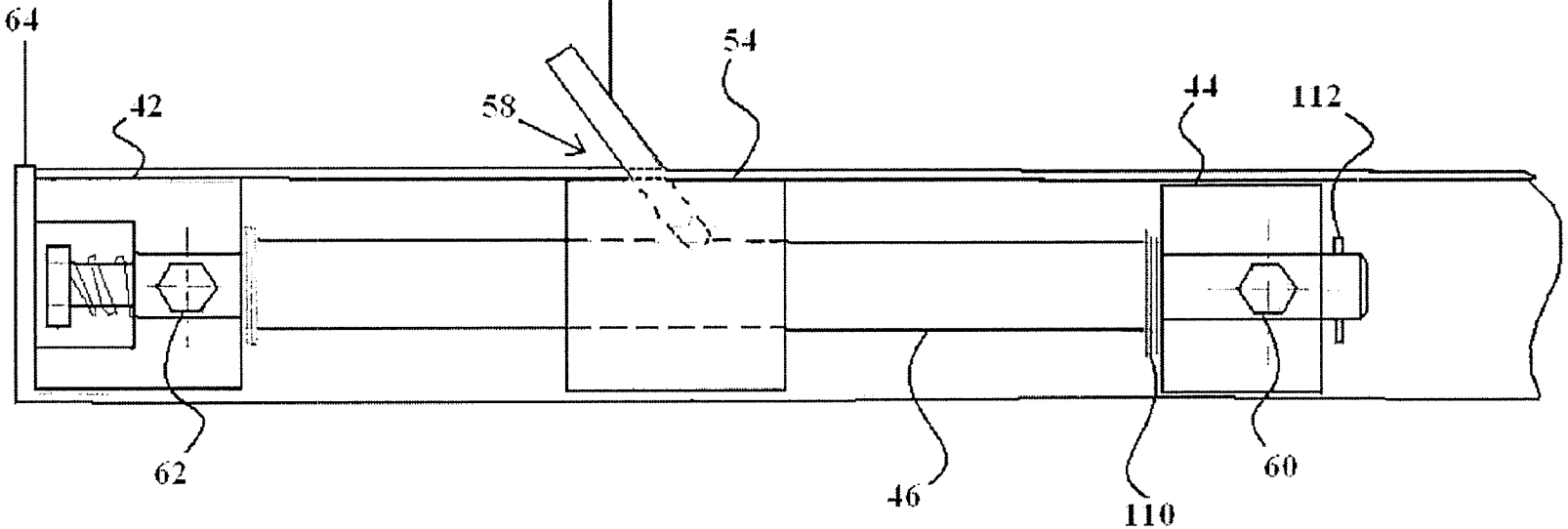
FIG. 6 shows a side view the embodiment of the tensioner of FIG. 5.

Web extensions 29*a*, 29*b*, 29*c*, and 29*d* are used at the corners of the web strips 28*a*, 28*b*, 28*c*, 28*d* to connect to hooks on the tensioner that is described more fully in FIGS. 5 and 6. The web system includes web extensions 29*a*, 29*b*, 29*c*, and 29*d*. In an embodiment, the web extensions are disposed at the end of each web strip for further tensioning the fabric cover to the hook of the tensioner.

A web extension can be made from any type of structurally sound fabric, polymer, metal and is typically made from pieces of webbing or a combination of webbing and a metal "D" ring. Each web extension is generally the same width as the web strips used within the web system, though web extensions can be wider or more narrow. Each web extension can range from 1 inch to 8 inches in length. The web extensions can be a loop for engaging a hook of the invention, which is described below, or a tab for engaging a belt like material or loop secured to a hook of the invention.

FIG. 5 shows the tensioner 30 formed in an end of rafter 14. In the end of the rafter 14, an opening 39 is formed. The opening is formed along the axis 40 of the rafter.

Within the rafter 14 is placed a first fitting 42. In another embodiment, two fittings can be used. FIG. 5 shows the embodiment with 2 fittings, first fitting 42 and second fitting 44. Through the center of the fittings is threaded a rod 46. On the outside of the rod 46 are formed threads 48 enabling a sliding block 54 to threadably engage the rod. In this embodiment, the threads on the rod are only the length of the opening. It is contemplated that the threads could extend along the entire rod between the two fittings.

Next, there are means for engaging the rod shown as element 50. These means for engaging the rod 50 can be a threaded bolt, threaded into the interior of the rod, or a hex head rivet fixed to one end of the rod, such as by welding. In yet another embodiment, the means for engaging can be bolt inserted into the rod and then welded to the rod.

In an embodiment, biasing means 52 can be used between the means for engaging the rod and the first fitting 42. The biasing means can be used to prevent the rod from releasing tension and to keep a tight fit so the rod does not unswivel during high winds, which would be dangerous. The biasing means can be a spring, such as a one inch length spring having a 0.5 inch diameter using wire that is 1/16 inch in diameter.

The first fitting is disposed between the opening 39 and an end of the rafter 14. In the embodiment of FIG. 5, the first fitting is securely connected to the rafter 14, such as with a bolt. The rod 46 is oriented in the rafter 14 along the axis 40 of the rafter through the first fitting 42.

A sliding block 54 with hook 56, which is shown better in FIG. 6, is placed disposed on the threads of the rod 46 within the rafter 14 so that the hook 56 can extend through the opening 39 and be used for engaging and tensioning the fabric cover.

In an embodiment, it is contemplated that the sliding block with hook can be a one piece structure with the hook threaded or otherwise secured to the sliding block. Alternatively, the sliding block and hook can be a multipart structure for easier insertion into the rafter and through the opening 39.

It is contemplated that the hook can be connected to the sliding block at an angle greater than 0 and less than 180 degrees from the axis of the rafter. One embodiment contemplates the angle of the hook being 60 degrees from the axis of the rafter.

If the second fitting is used, as shown in FIG. 6, it is contemplated that the second fitting 44 is disposed inside the rafter 14 on a side of the opening 39 (depicted in FIG. 5) opposite the first fitting 42. The second fitting is made to receive the rod through a central hole, like the first fitting.

It is also contemplated, that the second fitting can secured to the rafter with a fastener, such as bolts. FIG. 6 depicts the fastener for the second fitting 44 as bolts, of which bolt 60 is shown. It is also contemplated that two bolts, could be used, one bolt on either side of the fitting. The first fitting 42 is also shown connected by bolts, of which bolt 62 is shown.

In alternative embodiments, the first and second fitting can be connected to the rafter by one or more screws, by welding the fittings to the rafter, by using an adhesive such as an epoxy, or by using a combination of these elements.

In FIG. 6 a hook 56 is shown inserted into the sliding block 54 at an angle 58, which is depicted in the embodiment to be about 30 degrees. It is also contemplated that a thrust bearing 110 can be used between the second fitting 44 and the rod 46. In this embodiment, the tensioner is contemplated to have a diameter ranging from 1 inch to 3 inches, and length ranging from 5 inches to 12 inches within the rafter end.

A pin 112 can be used to hold the rod 46 on the other side of the second fitting 44 for secure attachment through the first fitting 42 and the second fitting 44. The securing means could be a 0.5 inch hex nut.

An end cap 64 is shown disposed over the means for engaging the rod. An end cap can be used for a variety of purposes, such as preventing rusting, preventing foreign materials from entering and damaging or obstructing function of the tensioner, or for aesthetic purposes.

Figure 7:
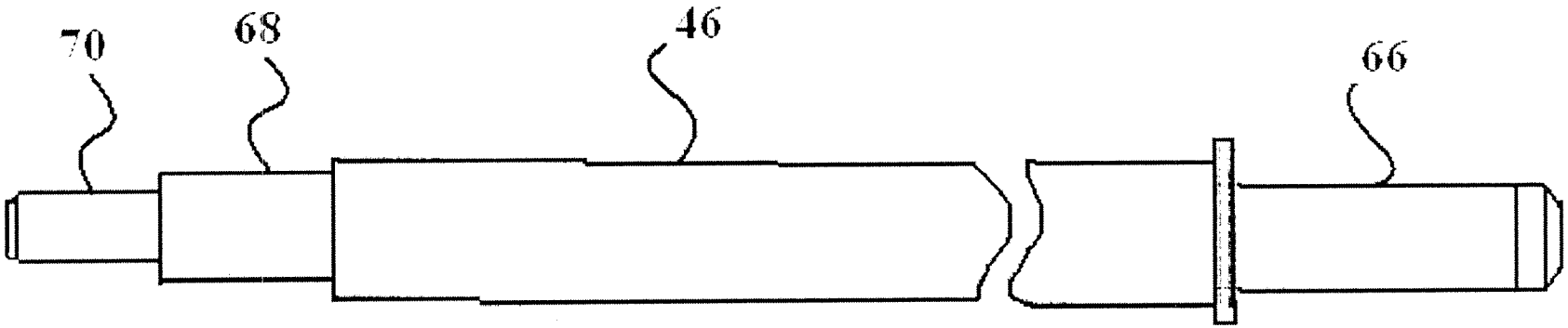
FIG. 7 shows a side view of an embodiment of the rod.

FIG. 7 shows a side view of an embodiment of the rod 46 usable herein. A first rod end 66 is shown having a diameter smaller than the portion of the rod with threads. A second rod end 68 is depicted having a diameter smaller than the portion of the rod with threads on the end opposite the first rod end 66. Further, there is depicted a second rod end extension 70, having a diameter smaller than second rod end 68, for receiving a hex head. The hex head can be flush to the end of the rafter and contained within the rafter.

Figure 8:
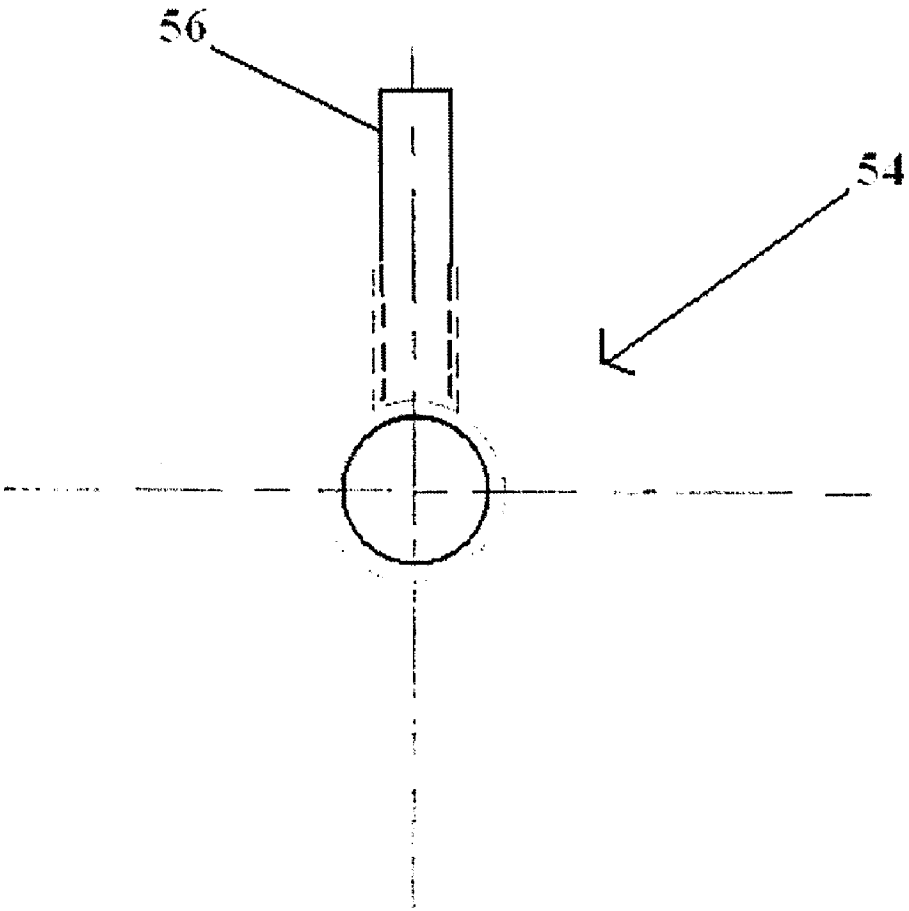
FIG. 8 shows a top view of an embodiment of the sliding block with hook usable with the tensioner.

FIG. 8 shows a top view of the sliding block 54 with the hook 56 as a two part construction.

While these embodiments have been described with emphasis on the embodiments, it should be understood that within the scope of the appended claims, the embodiments might be practiced other than as specifically described herein.

What is claimed is:

1. A fabric covered rigid frame structure comprising:

at least three elongate rafters, each having an axis;

at least one column supporting each of the at least three elongate rafters;

a fabric cover covering the at least three elongate rafters;

a web system comprising a plurality of separate web strips, separate from the fabric cover, hemmed into edges of the fabric cover; and at least one tensioner formed in an end of at least one elongate rafter, wherein the tensioner comprises:

an opening formed in an end of the at least one elongate rafter, wherein the opening is formed along the axis of the at least one elongate rafter;

a first fitting disposed between the opening and an end of the at least one elongate rafter, wherein the first fitting is connected to the at least one elongate rafter;

a rod disposed in the at least one elongate rafter along the axis of the at least one elongate rafter through the first fitting, wherein the rod comprises threads that are exposed to at least a portion of the opening;

means for engaging the rod through the first fitting; and a cylindrical sliding block disposed within the at least one elongate rafter, wherein the cylindrical sliding block has an outer diameter substantially similar to an inner diameter of the elongate rafter, and wherein the cylindrical sliding block has a longitudinal threaded aperture for receiving the threaded rod and engaging the threads of the rod, and wherein a hook is attached to the cylindrical sliding block and the hook extends through the opening directly engaging the web strips and the fabric cover, and tensioning the fabric cover.

2. The structure of claim 1, wherein the sliding block with the hook is an at least one piece structure.

3. The structure of claim 1, wherein the hook is connected to the sliding block at an angle from 0 degrees to 180 degrees from the axis of the at least one elongate rafter.

4. The structure of claim 1, further comprising a biasing means disposed between the means for engaging the rod and the rod to prevent the rod from releasing tension.

5. The structure of claim 1, further comprising a second fitting disposed inside the at least one elongate rafter on a side of the opening opposite the first fitting, and wherein the second fitting is adapted for receiving the rod and the second fitting is secured to the at least one elongate rafter.

6. The structure of claim 5, wherein the first fitting and the second fitting are connected to the at least one elongate rafter by a connecting means, and wherein the connecting means comprises at least one bolt, at least one screw, welding, adhesive, or combinations thereof.

7. The structure of claim 1, wherein the web system further comprises a web extension disposed at the end of each web strip for further tensioning the fabric cover to the hook.

8. The structure of claim 1, wherein the at least one column is anchored to a foundation, earth, or another structure.

9. The structure of claim 1, wherein at least two elongate rafters connect to at least one rigid beam and each of the at least two elongate rafters engages opposite sides of a support beam.

10. A fabric covered rigid frame structure comprising:

at least three elongate rafters, each elongate rafter having an axis;

at least one column supporting each of the at least three elongate rafters;

a fabric cover covering the at least three elongate rafters;

a cord system comprising a cord hemmed into edges of the fabric cover; and at least one tensioner formed in an end of the at least one elongate rafter, wherein the at least one tensioner comprises:

an opening formed in an end of the at least one elongate rafter, wherein the opening is formed along the axis of the at least one elongate rafter;

a first fitting disposed between the opening and an end of the at least one elongate rafter, wherein the fitting is securely connected to the at least one elongate rafter;

a rod disposed in the at least one elongate rafter along the axis of the at least one elongate rafter through the first fitting, wherein the rod comprises threads that are exposed to at least a portion of the opening;

means for engaging the rod through the first fitting; and a cylindrical sliding block disposed within the at least one elongate rafter, wherein the cylindrical sliding block has an outer diameter substantially similar to an inner diameter of the elongate rafter, and wherein the cylindrical sliding block has a longitudinal threaded aperture for receiving the threaded rod and engaging the threads of the rod, and wherein a hook is attached to the cylindrical sliding block and a hook extends through the opening directly engaging the cord and the fabric cover and tensioning the fabric cover.

11. The structure of claim 10, wherein the cord comprises a wire, a cable, a chain, a hemp cord, a cotton rope, a nylon rope, a synthetic polymer rope, or combinations thereof.

12. The structure of claim 10, wherein the sliding block with the hook is an at least one piece structure.

13. The structure of claim 10, wherein the hook is connected to the sliding block at an angle from 0 degrees to 180 degrees from the axis of the at least one elongate rafter.

14. The structure of claim 10, further comprising a biasing means disposed between the means for engaging the rod and the rod to prevent the rod from releasing tension.

15. The structure of claim 10, further comprising a second fitting disposed inside the at least one elongate rafter on a side of the opening opposite the first fitting, and wherein the second fitting is adapted for receiving the rod and the second fitting is secured to the at least one elongate rafter.

16. The structure of claim 15, wherein the first fitting and the second fitting are connected to the at least one elongate rafter by a connecting means, and wherein the connecting means comprises at least one bolt, at least one screw, welding, adhesive, or combinations thereof.

17. The structure of claim 10, wherein the at least one column is anchored to a foundation, earth, or another structure.

18. The structure of claim 10, wherein at least two elongate rafters connect to at least one rigid beam and each of the at least two elongate rafters engages opposite sides of a support beam.

* * * * *